US007953237B2

(12) United States Patent
Sporer

(10) Patent No.: US 7,953,237 B2
(45) Date of Patent: May 31, 2011

(54) METHOD FOR OPERATING A HEARING AID DEVICE SYSTEM FOR THE BINAURAL SUPPLY OF A USER

(75) Inventor: Gerhard Sporer, Lauf (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1233 days.

(21) Appl. No.: 11/541,265

(22) Filed: Sep. 29, 2006

(65) Prior Publication Data

US 2007/0076910 A1 Apr. 5, 2007

(30) Foreign Application Priority Data

Sep. 30, 2005 (DE) ..... 10 2005 047 049

(51) Int. Cl.
*H04R 25/00* (2006.01)

(52) U.S. Cl. ..... 381/312; 381/314; 381/315; 381/320

(58) Field of Classification Search ..... 381/312, 381/317, 318, 23.1, 320, 92, 314, 321, 315
See application file for complete search history.

(56) References Cited

U.S. PATENT DOCUMENTS

| | | | | |
|---|---|---|---|---|
| 5,757,932 | A | 5/1998 | Lindemann et al. | |
| 5,991,419 | A | 11/1999 | Brander | |
| 6,540,633 | B1 | 4/2003 | Hasegawa et al. | |
| 6,549,633 | B1 * | 4/2003 | Westermann | 381/312 |
| 6,768,802 | B1 | 7/2004 | Baechler | |
| 7,020,296 | B2 | 3/2006 | Niederdränk | |
| 2003/0215106 | A1 | 11/2003 | Hagen et al. | |
| 2004/0175008 | A1 | 9/2004 | Roeck et al. | |

FOREIGN PATENT DOCUMENTS

| | | | |
|---|---|---|---|
| DE | 100 48 354 | A1 | 5/2002 |
| DE | 103 04 648 | B3 | 8/2004 |
| EP | 0924958 | A1 | 6/1999 |
| EP | 0 941 014 | A2 | 9/1999 |
| WO | 9714268 | A1 | 4/1997 |
| WO | 9943185 | A1 | 8/1999 |
| WO | WO 00/00001 | A2 | 1/2000 |

OTHER PUBLICATIONS

Dillon, "Hearing Aids", 2001, pp. 1-11, ISSBN 1-58890-052-5, Boomerang Press, Sydney.
Sataloff et al., "Occupational Hearing Loss", 1993, ISBN 0-8427-8814-1, Occupational Safety and Health:24, Marcel Dekker, Inc., New York.

* cited by examiner

*Primary Examiner* — Tuan D Nguyen

(57) ABSTRACT

In a hearing aid device system with a hearing aid device which can be worn on or in the left ear of a user and a hearing aid device which can be worn on or in the right ear of the user for the binaural supply of the user, the aim is to reduce feedback tendency. To this end, it is proposed to transmit audio signals resulting from the microphone signals of the hearing aid devices in a crosswise fashion between the hearing aid devices and thus to emit an acoustic signal recorded by the microphone of a hearing aid device, after the signal processing and amplification, by means of the receiver of the respective other hearing aid device. In this way, the distance between each receiver and microphone, between which a feedback path exists, is essentially increased for the relevant audio signals.

12 Claims, 2 Drawing Sheets

METHOD FOR OPERATING A HEARING AID DEVICE SYSTEM FOR THE BINAURAL SUPPLY OF A USER

CROSS REFERENCE TO RELATED APPLICATIONS

This application claims the benefits of German Patent application No. 10 2005 047 049.1 filed Sep. 30, 2005. All of the applications are incorporated by reference herein in their entirety.

FIELD OF THE INVENTION

The invention relates to a method for operating a hearing aid device system with a first hearing aid device which can be worn on or in the left ear of a user and a second hearing aid device which can be worn on or in the right ear of the user, with the hearing aid devices each comprising at least one microphone for recording an acoustic input signal and converting said signal into an audio signal, a signal processing facility for processing an audio signal and an output converter for converting a processed audio signal into a signal which can be perceived by the user as an acoustic signal as well as means for transmitting an audio signal from each respective hearing aid device to the other respective hearing aid device, with a first audio signal being generated by the microphone of the first hearing aid device at least for one specific frequency range and this first audio signal or an audio signal emanating therefrom being transmitted to the second hearing aid device and being emitted by the receiver of the second hearing aid device after signal processing and a second audio signal being generated at the same time by the microphone of the second hearing aid device, and this second audio signal or an audio signal emanating therefrom being transmitted to the first hearing aid device and being output by the receiver of the first hearing aid device after signal processing.

BACKGROUND OF THE INVENTION

With one hearing aid device, an input signal is recorded by means of an input converter and is converted into an electrical input signal. Typically, at least one microphone which records an acoustic input signal serves as an input converter. Modern hearing aid devices frequently comprise a microphone system with a number of microphones, in order to achieve a reception which is dependent on the direction of incidence of acoustic signals, a directional characteristic.

The input converters can however also have a telephone coil or an antenna in order to record electromagnetic input signals. The input signals converted into electrical signals (audio signals) by means of the input converter are fed to a signal processing unit for further processing and amplification. The further processing and amplification is generally carried out as a function of the signal frequency in order to compensate for the individual hearing loss of a hearing aid device wearer. The signal processing unit generates an electrical output signal, which is fed to the ear of the hearing aid device wearer by means of an output converter, so that said hearing aid device wearer perceives the output signal as an acoustic signal. Receivers which generate an acoustic output signal are typically used as output converters. Nevertheless, output converters for generating mechanical vibrations are also known, which directly stimulate certain parts of the ear to vibrate, such as the ossicles for instance. Furthermore, output converters are known, which directly stimulate nerve cells in the ear.

As a result of the miniaturization sought in hearing aid devices, the microphone and the receiver of a hearing aid device are generally only distanced minimally from one another. This promotes an unwanted sound transmission directly from the receiver to the microphone, thereby frequently resulting in disturbing feedback whistling (feedback). A plurality of different approaches exist for solving this problem, such as the use of notch filters, adaptive filters, directional microphones or an extensive sealing of the auditory canal. None of these measures has however previously been able to reliably and completely eliminate the occurrence of feedback-related whistling.

U.S. Pat. No. 5,757,932 discloses a hearing aid device system with a hearing aid device which can be worn on the left ear and a hearing aid device on the right ear of a user. Audio signals are transmitted between the hearing aid devices. Signals, which represent acoustic signals recorded on both ears, are thus processed in both hearing aid devices. In this way, a binaural output signal can be fed to both ears of the user.

EP 941014 A2 discloses a hearing device system, in which hearing device system a control signal is transmitted from one hearing device to a second hearing device.

DE 10048354 A1 discloses a hearing device system having two hearing devices, in which acoustic field characteristics are generated in each hearing device and are transmitted to the respective other hearing device.

WO 00/00001 A2 discloses a hearing device system with two hearing devices, in which the signal processing in the two hearing devices is synchronized between the hearing devices by means of a wireless connection.

A method for communicating between hearing devices is known from DE 10304648 B3, in which data packets of a higher priority are first transmitted.

EP 0 941 014 A2 discloses a hearing aid device system with two hearing aid devices which can be worn on the head for the binaural supply of a user. The hearing aid devices comprise means for the wireless transmission of control signals and audio signals between the hearing aid devices. This allows the audio signals obtained in the two hearing aid devices by means of the microphone to be at least partially processed in only one of the two hearing aid devices. Resources for signal processing must thus not be similarly provided in both hearing aid devices.

The known hearing aid devices are disadvantageous in that the feedback problem has previously only been unsatisfactorily solved.

SUMMARY OF THE INVENTION

The object of the present invention is thus to largely avoid feedback in a hearing aid device system for the binaural supply of a user.

This object is achieved by the method for operating a hearing aid device system as claimed in the claims.

With a hearing aid device system having two hearing aid devices for the binaural supply of a hearing impaired person, the basic concept behind the invention is thus to disconnect the signal paths of hearing aid devices, which lead from one microphone to a receiver by means of a signal processing unit. An audio signal starting from the microphone of the hearing aid device worn on the left ear is transmitted to the hearing aid device worn on the right ear and is output by the receiver of the hearing aid device worn on the right ear. An audio signal starting from the microphone of the hearing aid device worn on the right ear is likewise transmitted to the left hearing aid device and is output by the receiver of the left hearing aid device. The distance between a microphone and a receiver, between which a feedback path exists, was thus considerably increased. The head of the user essentially determines the feedback path both in respect of the acoustic feedback path and also the transmission of impact sound between the relevant receiver and the relevant microphone. If, with conventional hearing aid devices, the distance between a receiver and a microphone, between which a feedback path is set up, lies in the range of millimeters up to a maximum of a few centimeters, this distance increases to several decimeters with a hearing aid device system according to the invention.

The invention is above all advantageous in the case of a significant hearing loss, since the required high amplification here increasingly results in feedback. In the case of a severely hearing impaired person provided with a hearing device system according to the invention, familiarization is to be expected after a short while, so that the direction of an incoming acoustic signal is once again correctly interpreted. In this regard, the brain of the person appears here to be adaptive. It is namely known that with vision, the images detected by the eyes are projected in a mirror-inverted manner onto the respective retina. We must thus actually see all things "upside-down". If probands are equipped with special glasses which produce a mirror-inverted representation, said probands first actually see everything "upside-down". This impression surprisingly disappears however after a few days, and everything is once again viewed as "normal". After wearing the glasses for a considerable time, when the glasses in question are removed, the same problems occur again as when the probands started to wear the glasses.

A similar effect as that illustrated from the field of vision also occurs with hearing, so that the transposition of signals, after a familiarization phase, is no longer perceived to be interfering. Particularly with the supply of the severely hearing-impaired, for whom feedback represents a major problem and who can scarcely hear at all without hearing devices, the familiarization effect is not canceled out again as a result of temporarily not wearing hearing devices.

The points in the signal paths of the hearing aid devices, at which the signal paths are separated for signal transmission between the hearing aid devices, can in principle be selected almost at random. A separation "near the microphone" can occur, in which the audio signals emitted by the microphone are not or hardly further processed before they are transmitted in a crosswise fashion between the hearing aid devices. A separation "near the receiver" can likewise also take place, with which the audio signals generated by the microphones are at least essentially already further processed. This is quite feasible particularly with digital hearing aid device systems, in which only numerical series are already transmitted between the hearing aid devices and the energy required for the signal transmission is thus approximately independent of the degree of amplification of the audio signals. It is certainly worth noting that with this signal transmission taking place at the end of the signal path, the signal processing taking place in the hearing aid device worn on the left ear must be adjusted if necessary to the hearing loss of the right ear and vice versa. The separation of the signal paths can, in principle, naturally also take place at any point between the two said extremes. An unsymmetrical separation of the signal paths is also possible, so that with a hearing aid device a signal is forwarded to a point in the signal path and is sent to another hearing aid device, if the signal processing has already essentially been concluded and the same hearing aid device receives the approximately unprocessed audio signal of the other hearing aid device for further processing. The signal processing herewith mainly concentrates on one of the two hearing aid devices of the hearing aid device system.

The signal transmission between the hearing aid devices worn on the right and on the left ear is preferably carried out wirelessly. This increases the wearing comfort of the hearing aid device system according to the invention. Provision can however also be made for a less comfortable, but nevertheless more cost-effective wired audio signal transmission. Furthermore, the signals are preferably transmitted directly between the two hearing aid devices worn on or in the ear. The signal transmission can however also be carried out via a further device, e.g. an external processor unit worn on the head.

The microphone signals starting from the microphones are preferably completely transmitted to the respective other hearing aid device in a crosswise fashion. It is however also possible, within the framework of the invention, to transmit only specific frequency ranges of the audio signals between the hearing aid devices. Frequency ranges for which no problems with feedback are expected do not need to be transmitted. In this way, the data quantity to be transmitted between the hearing aid devices can be reduced.

With hearing aid devices, a parallel processing of the audio signals generated by the microphone is carried out in several parallel frequency bands (channels). With hearing aid devices of this type, certain channels can be advantageously transmitted in a crosswise fashion between the hearing aid devices.

In a preferred development of the invention, a cross-over transmission of audio signals is then only carried out between a hearing aid device worn on or in the left ear of a user and a hearing aid device worn on or in the right ear of a user, when a high probability of feedback occurrence has to be anticipated. This is particularly the case if an acoustic input signal undergoes a high amplification. Feedback then regularly occurs if a high acoustic pressure level is generated by the receiver of the relevant hearing aid device. The set amplification and/or generated acoustic pressure level is preferably monitored in a hearing aid device system according to the invention in that when specific threshold values are exceeded, an automatic cross-over transmission according to the invention takes place. Advantageously, the threshold values can be set by programming the hearing aid devices. With the further development, the monitoring and cross-over transmission can preferably also occur in each instance for specific frequency ranges and/or channels.

With one variant of the invention, the crosswise transmission of audio signals is restricted to one or a number of specific audio programs. The cross-over transmission is thus only carried out with audio programs for which this transmission was also provided explicitly, e.g. by programming the hearing aid devices. There are generally no disadvantages associated with listening to music or watching television using entertainment electronics for instance, if the signals fed to the right and the left ear are exchanged.

In this way, the invention can be particularly advantageously used in the hearing situations "television" and "music", in which due to the large dynamic scope of the acoustic input signals, feedback occurs particularly frequently.

With another variant of the invention, the hearing aid devices each comprise a number of microphones for forming directional microphones with directional characteristics of a different order. In particular, with hearing aid devices of this type, audio signals can be processed at the same time, said audio signals emanating from the directional microphones of a different order. According to the invention, it is possible with hearing aid devices of this type, to transmit the audio signals from microphones and/or microphone systems of a specific order in a crosswise fashion between the hearing aid devices. By way of example, only audio signals starting from omnidirectional microphones are thus transmitted in a crosswise fashion between the hearing aid devices and audio signals starting from directional microphones of a first or higher order, with which feedback-related whistling occurs less regularly, are not transmitted.

In conjunction with the invention, a complete separation of the signal path between the microphone and the receiver is preferably carried out at least for one specific frequency range. This means that no audio signal gained from the microphone signal of the same hearing aid device for this frequency range is fed to the receiver of this hearing aid device. It is however also possible within the scope of the invention not to separate the signal path completely. With this exemplary embodiment, an audio signal is likewise tapped off from the signal path of the first hearing aid device and is transmitted to the second hearing aid device of the hearing aid device system, in parallel with this, signal processing of the audio signal present at the tapping off point in the first hearing aid device and a signal output of the processed signal by the receiver of the first hearing aid device is carried out. The signal processing is however carried out here within the scope of the invention such that feedback by this signal can be excluded with great probability in the case of the first hearing aid device. The relevant signal is thus generally emitted by the second hearing aid device with a higher acoustic pressure level than by the first, if the same hearing loss is approximately present in both ears. Feedback then can be excluded with great probability if the so-called loop amplification for a signal passing through the relevant hearing aid device is always less than one even in an unfavorable situation, e.g. even with a poorly fitted otoplastic. A threshold value, which illustrates an upper limit for the amplification, is set accordingly.

BRIEF DESCRIPTION OF THE DRAWINGS

The invention is described below with reference to exemplary embodiments, in which.

DETAILED DESCRIPTION OF THE INVENTION

Figure 1:
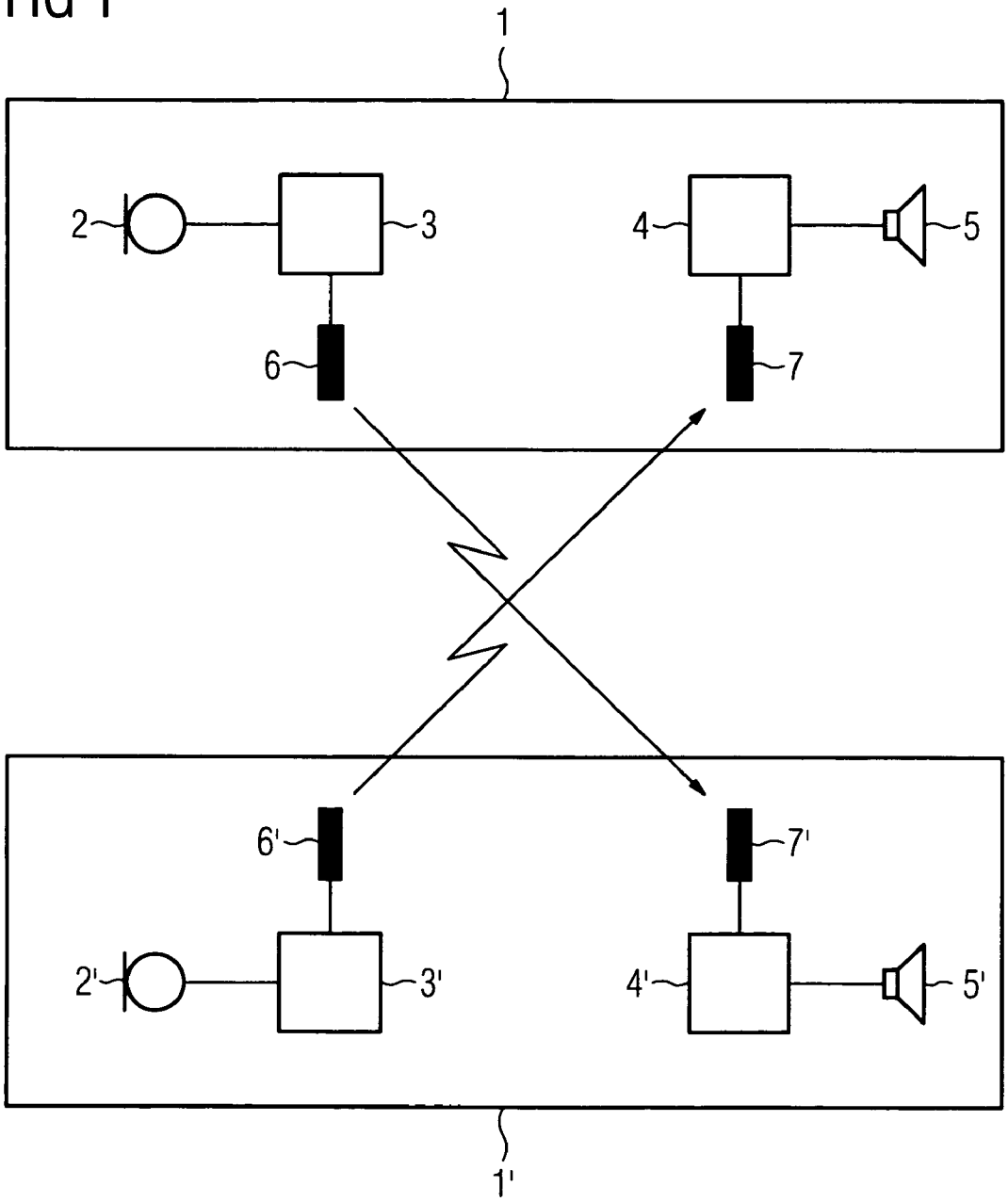
FIG. 1 shows the basic principle of a hearing aid device system according to the invention and FIG. 2 shows a hearing aid device system with a directional microphone system and parallel signal processing in several frequency bands.

The exemplary embodiment according to FIG. 1 shows a hearing device system 1, 1' according to the invention with a left and right hearing device 1 and/or 1'. Each hearing device 1 and/or 1' comprises a microphone 2 and/or 2', a first signal processing unit 3 and/or 3', a second signal processing unit 4 and/or 4' and a receiver 5 and/or 5'. The first signal processing units 3 and/or 3' are each connected to a transmitter coil 6 and/or 6' and the second signal processing units 4 and/or 4' are each connected to a receiver coil 7 and/or 7'. A wireless signal transmission takes place from the transmitter coil 6 of the left hearing device 1 to the receiver coil 7' of the right hearing device 1' as well as from the transmitter coil 6' of the right hearing device 1' to the receiver coil 7 of the left hearing device 1. This arrangement allows an acoustic signal recorded by the microphone 2 of the hearing aid device 1 which can be worn on the left ear to be fed to the right ear of a user after signal processing and amplification by means of the hearing aid device system 1, 1', and at the same time an acoustic signal recorded by the microphone 2' of the hearing aid device 1' which can be worn on the right ear is fed to the left ear of the user after signal processing and amplification by means of the hearing aid device system 1, 1'. Feedback is avoided as far as possible by the large distance between the microphone 2 and/or 2' for recording the acoustic input signal from the receiver 5'and/or 5, which emits the amplified microphone signal.

In contrast to the illustrated exemplary embodiment with separate transmitter coils 6 and/or 6' and receiver coils 7 and/or 7', a single coil or antenna can naturally also be present in each hearing aid device, said single coil or antenna being suited both to transmitting and also receiving signals.

Figure 2:
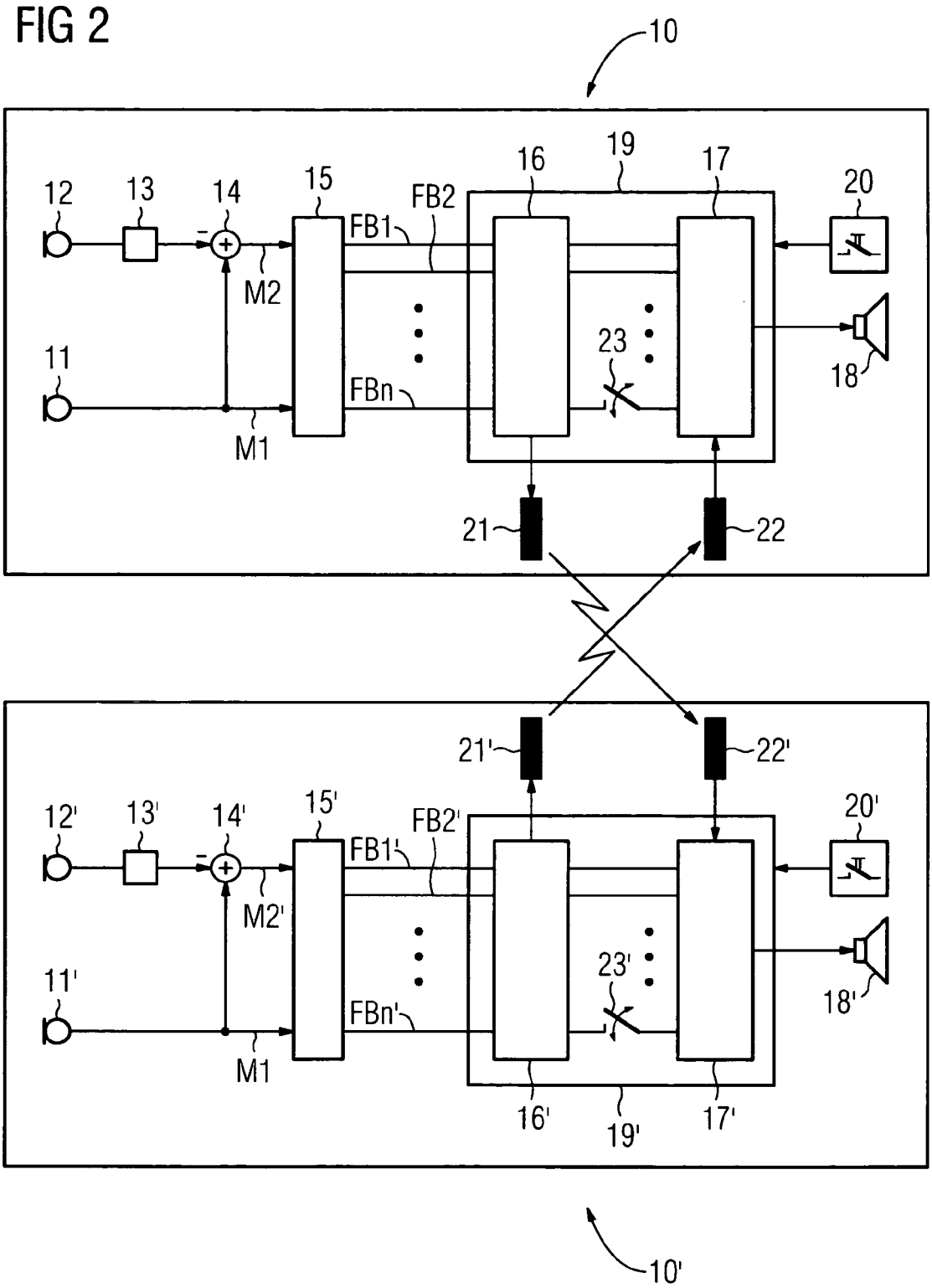

The hearing aid device system according to FIG. 2 has two identically designed hearing aid devices 10 and 10'. The hearing aid device 10 here comprises the two omnidirectional microphones 11 and 12. On the one hand, the audio signal starting from the omnidirectional microphone 11 is fed directly to a filter bank 14 and on the other hand, it is electrically interconnected to the omnidirectional microphone 12 in order to form a directional microphone system of the first order. For this purpose, the audio signal starting from the omnidirectional microphone 12 is first delayed in a delay unit 13 and subtracted from the audio signal of the microphone 11. The audio signal M2 of the directional microphone of the first order thus designed is first fed to the filter bank 15, in which the audio signals are divided into a number of frequency bands. The parallel signal processing is carried out in the signal processing blocks 16 and 17 of the signal processing unit 19. The same cut-off frequencies are preferably also selected for the different frequency bands in both hearing aid devices.

In accordance with the invention, the signal path between the signal processing blocks 16 and 17 is interrupted for at least one frequency band, the band FBn in the exemplary embodiment. A signal proportion of the frequency band FBn of the audio signals M1 and/or M2 is thus not fed to the receiver 18. This signal proportion is instead transmitted over the transmitter coil 21 and the receiver coil 22' to the hearing aid device 10' and is output by the hearing aid device 10' by means of the receiver 18'. Signal processing in the signal processing block 17', e.g. amplification, is still preferably carried out prior to the signal emission. The audio signal in the frequency band FBn' is transmitted in parallel from the hearing aid device 10' over the transmitter coil 21' and the receiver coil 22 to the hearing aid device 10, and is fed to the receiver 18 after signal processing in the signal processing block 17. The crosswise signal transmission thus described can be designed for one or several particularly critical frequency bands, with regards to the feedback tendency. The relevant frequency bands can preferably be selected for instance by programming the hearing aid devices.

With the known variants of the invention, the signal paths of the hearing aid devices 10 and 10' for the frequency bands FBn and/or FBn' are interrupted by the opened switches 23 and 23' between the signal processing blocks 16 and 17 and/or 16' and 17'. The output signal emitted by the receiver 18 thus contains no signal proportion in the frequency band FBn which emanates from the microphone signals M1 and M2 and the output signal emitted by the receiver 18' does not contain any signal proportion in the frequency band FBn' which emanates from the microphone signals M1' and M2'.

With another variant of the invention, the switches 23 and/or 23' are missing, or they then also remain closed at least in specific application cases, if a crossover transmission of audio signals is carried out for the critical frequency bands FBn and/or FBn'. The amplification is set for the signals in the relevant frequency ranges such that feedback is eliminated. An output signal is thus fed to the ear, said output signal featuring the complete transmittable bandwidth of an input signal detected by the microphone, nevertheless only in weakened form in respect of the amplification required for this frequency band to compensate for the individual hearing loss of the hearing aid device wearer. In contrast, the transmitted signal is fed to the other ear at the volume required for this other ear.

With another variant of the invention, provision is made for the two microphone signals M1 and M2 emanating from directional microphone systems of a different order to be treated differently in respect of the signal transmission according to the invention. In particular the microphone signals M1 and M1' emanating from the two omnidirectional microphones 11 and 11' are advantageously transmitted in a crosswise fashion to the respective other hearing aid device and the microphone signals M2 and/or M2' which are less critical in respect of the feedback tendency are not transmitted to the respective other hearing aid device. This procedure is advantageous in that the data quantity to be transmitted is reduced.

The signal processing in both hearing aid devices 10 and 10' is preferably carried out as a function of the hearing situation, in which the hearing aid device momentarily finds itself. In this way, an automatic adjustment can be carried out, which for instance is based on an analysis of the audio signals in the signal processing blocks 16 and/or 16'. Furthermore, it is possible with the hearing aid devices 10 and 10' according to the exemplary embodiment to manually switch between different audio programs by means of the program switches 20 and 20'. With a further development of the invention, provision is made for the selection of audio signals, e.g. M1, M1' and/or M2, M2' or the selection of the transmitted frequency band/s to be carried out as a function of the current hearing situation and/or the current audio program, e.g. an at least largely crosswise transmission of the audio signals can take place in the hearing situation "listening to music", as in this hearing situation it is generally insignificant from which direction a tone signal in the hearing aid device system appears to occur. In contrast to this, the crosswise transmission can be at least largely avoided in a hearing situation "street traffic", with which an increased feedback tendency of the relevant hearing aid device system is associated.

Furthermore, with one development of the invention, the required amplification of a present audio signal or of the acoustic pressure level of the signal emitted by the user is automatically estimated at least for one specific frequency range. If one of these values exceeds a predetermined threshold value, a cross-over transmission according to the invention automatically occurs, or this is omitted. This ensures that a crosswise transmission of audio signals only takes place if this appears necessary for the purpose of avoiding feedback.

The invention claimed is:

1. A method for operating a hearing aid device system having a first hearing aid device to be worn on or in the left ear of a user and a second hearing aid device to be worn on or in the right ear of the user, comprising:

generating a first audio signal via a first microphone of the first hearing aid device;

processing the first audio signal via a first signal processing facility;

converting the first processed audio signal into a user perceivable acoustic output signal by a first output converter;

transmitting a first specific frequency range of the first audio signal from the first hearing aid device to a second receiver of the second hearing aid device;

processing the transmitted first audio signal via a signal processing facility of the second hearing aid device;

emitting the processed first audio signal by the second hearing aid device as a user perceivable second acoustic output signal;

generating a second audio signal via a second microphone of the second hearing aid device;

processing the second audio signal via a second signal processing facility;

converting the second processed audio signal into a user perceivable acoustic output signal by a second output converter;

transmitting a second specific frequency range of the second audio signal from the second hearing aid device to a first receiver of the first hearing aid device;

processing the transmitted second audio signal via a signal processing facility of the first hearing aid device; and emitting the processed second audio signal by the first hearing aid device as a user perceivable first acoustic output signal, wherein the second acoustic output signal emitted by the second hearing aid device emanates exclusively from the first audio signal at least for the first specific frequency range, and the first acoustic output signal emitted by the first hearing aid device receiver emanates exclusively from the second audio signal.

2. The method as claimed in claim 1, wherein a signal path between the first microphone and the first receiver of the first hearing aid device is disconnected relative to the first audio signal.

3. The method as claimed in claim 2, wherein the signal path between the second microphone and the second receiver of the second hearing device is disconnected relative to the second audio signal.

4. A method for operating a hearing aid device system having a first hearing aid device and a second hearing aid device, comprising:

generating a first audio signal via a first microphone of the first hearing aid device;

processing the first audio signal via a first signal processing facility;

converting the first processed audio signal into a user perceivable acoustic output signal by a first output converter;

transmitting a first specific frequency range of the first audio signal from the first hearing aid device to a second receiver of the second hearing aid device;

processing the transmitted first audio signal via a signal processing facility of the second hearing aid device;

emitting the processed first audio signal by the second hearing aid device as a user perceivable second acoustic output signal;

generating a second audio signal via a second microphone of the second hearing aid device;

processing the second audio signal via a second signal processing facility;

converting the second processed audio signal into a user perceivable acoustic output signal by a second output converter;

transmitting a second specific frequency range of the second audio signal from the second hearing aid device to a first receiver of the first hearing aid device;

processing the transmitted second audio signal via a signal processing facility of the first hearing aid device; and emitting the processed second audio signal by the first hearing aid device as a user perceivable first acoustic output signal, wherein the second acoustic output signal emanates from the first and the second audio signals at least for the specific frequency range, where a second amplification value associated with the second audio signal does not exceed an uncritical threshold value to avoid the occurrence of feedback, and a first amplification value is greater than a second amplification value associated with the second audio signal, wherein an amplification of the acoustic input signal required to compensate for a hearing loss of the user for at least one frequency range is determined by the first hearing aid device and the signal transmission between the hearing aid devices is performed as a function of the determined amplification or the acoustic pressure level of an acoustic output signal generated by the first hearing aid device is determined for at least one frequency range and the signal transmission between the hearing aid devices is performed as a function of the determined acoustic pressure level.

5. The method as claimed in claim 4, wherein the audio signals transmitted between the first and second hearing aid devices are transmitted via a wire.

6. The method as claimed in claim 4, wherein the audio signals transmitted between the first and second hearing aid devices are transmitted wirelessly.

7. The method as claimed in claim 4, wherein the first audio signal is transmitted completely to the second hearing aid device.

8. The method as claimed in claim 4, wherein only the first specific frequency range of the first audio signal is transmitted from the first hearing aid device to the second hearing aid device.

9. The method as claimed in claim 4, wherein a threshold values for the amplification is set by programming the first hearing aid device.

10. The method as claimed in claim 4, wherein a threshold values for the acoustic pressure level is set by programming the first hearing aid device.

11. The method as claimed in claim 4, wherein each hearing aid device comprises several interconnected microphones that form a directional microphone with directional microphone signals having different directional characteristics and only one directional microphone signal of a specific directional characteristic being transmitted from the first hearing aid device to the second hearing aid device.

12. The method as claimed in claim 4, wherein the signal transmission between the first and second hearing aid devices is a function of a momentary hearing situation, or a preset audio program.

* * * * *